United States Patent [19]

Hemmer et al.

[11] Patent Number: 4,470,658

[45] Date of Patent: Sep. 11, 1984

[54] CONTACT ASSEMBLY

[75] Inventors: Valentine J. Hemmer; R. Amelia Piscitelli, both of Sidney, N.Y.

[73] Assignee: The Bendix Corporation, Southfield, Mich.

[21] Appl. No.: 499,706

[22] Filed: May 31, 1983

[51] Int. Cl.[3] ..... H01R 11/22

[52] U.S. Cl. ..... 339/258 R; 339/276 T; 339/262 R

[58] Field of Search ..... 339/142, 252 R, 256 R, 339/258 R, 258 P, 259 R, 262 R, 275 T, 276 R, 276 T

[56] References Cited

U.S. PATENT DOCUMENTS 4,120,556 10/1978 Waldron et al. ..... 339/142

4,184,736 1/1980 Spaulding ..... 339/258 R 4,373,773 2/1983 Piscitelli et al. ..... 339/258 R X 4,431,256 2/1984 Piscitelli et al. ..... 339/258 R

*Primary Examiner*—John McQuade

*Assistant Examiner*—Steven C. Bishop

*Attorney, Agent, or Firm*—R. J. Eifler

[57] ABSTRACT

A slot (11) or a cutaway portion that includes an end surface (41) in an outer sleeve (10 or 40, 50) to provide an opening for a projection (25) in an inner sleeve so that the inner sleeve (20) may be located in a predetermined position within the outer sleeve (10) or sleeves (40, 50). A final outer sleeve (30) then is formed over a shoulder (42) of outer sleeve (40) to lock all the sleeves together. This eliminates the need for crimping the sleeves together.

6 Claims, 7 Drawing Figures

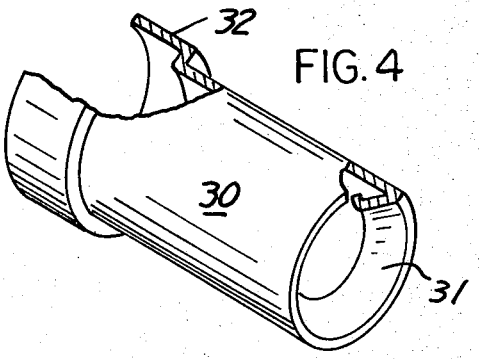
FIG. 4
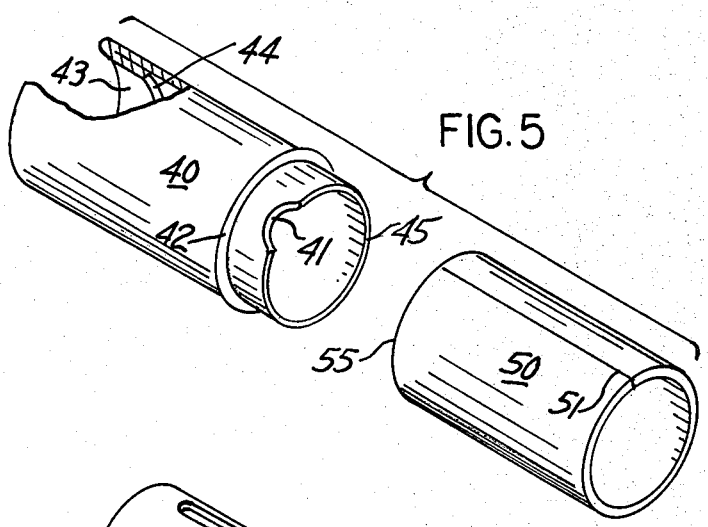
FIG. 5
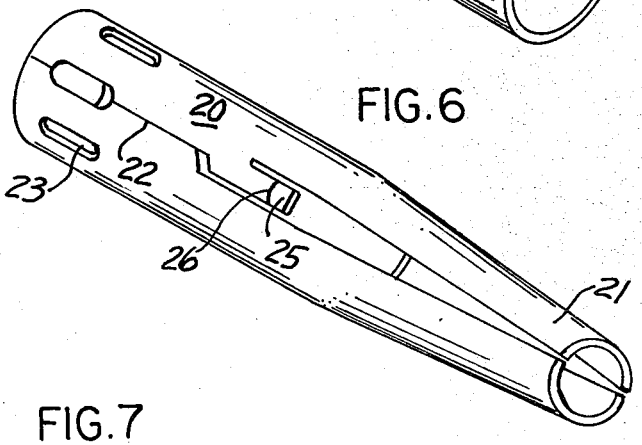
FIG. 6
FIG. 7
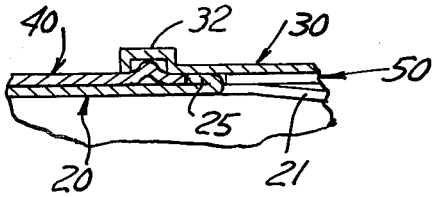

CONTACT ASSEMBLY

This invention relates to electrical connectors and more specifically to socket type electrical contacts mounted within the electrical connector.

Electrical connectors generally include a plug and receptacle each having an insert of dielectric material provided with a plurality of axially extending passages within which electrical contacts are retained. In most instances the contacts are pin and socket type contacts that are machined from a single solid piece of metal or stamped and formed from a thin sheet of metal to reduce the cost and weight of the contact. One example of a stamped and formed contact may be found in U.S. Pat. No. 4,120,556 entitled "Electrical Contact Assembly", issued Oct. 17, 1978. A stamped and formed contact assembly is generally comprised of two of more sleeves. The sleeves are connected together by a friction fit or by a crimp or punch between the sleeves to mechanically attach then together. However, crimping or punching while providing a good mechanical and electrical connection between the sleeves often causes deformation of the sleeves so that they are no longer round and therefore do not meet the requirements of certain customers specifications. Where the sleeves of the contact assembly are friction fit together, the problem of relative movement between the sleeves of a contact occurs upon mating of the contacts.

DISCLOSURE OF THE INVENTION

This invention eliminates friction fitting or crimping together the sleeves of a contact assembly. The invention is a contact assembly characterized by an inner sleeve that has a radial projection that is captivated between two outer sleeves. One of the outer sleeves includes a cut away portion to provide an aperture through which the radial projection of the inner sleeve may extend. In another embodiment of the invention the radial projection of the inner sleeve slides into a slot in an outer sleeve to locate the inner sleeve in a predetermined position within the outer sleeve.

Accordingly, it is an advantage of this invention to eliminate deformation of and relative movement between the sleeves of a contact assembly.

It is also an advantage of this invention to eliminate the need for crimpting together the sleeves of a contact assembly.

DETAILED DESCRIPTION OF THE INVENTION

FIGS. 4–7 illustrate another embodiment of the invention.

Figure 1:
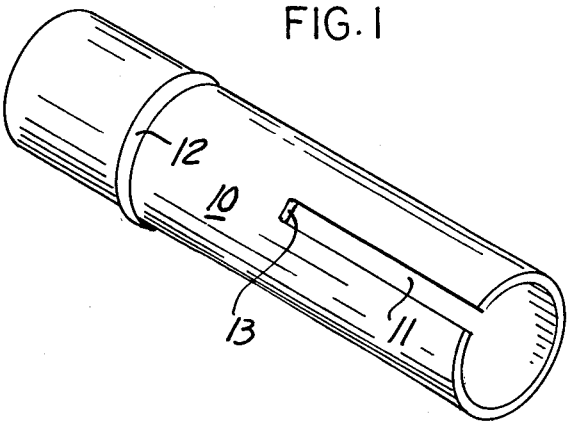
FIGS. 1–3 illustrate one embodiment of the invention.

Referring now to the drawings, FIG. 1 illustrates an outer sleeve 10 having an annular shoulder 12, and an axially extending slot 11 extending rearwardly from the front end of the sleeve and terminating in a forwardly facing shoulder 13.

Figure 2:
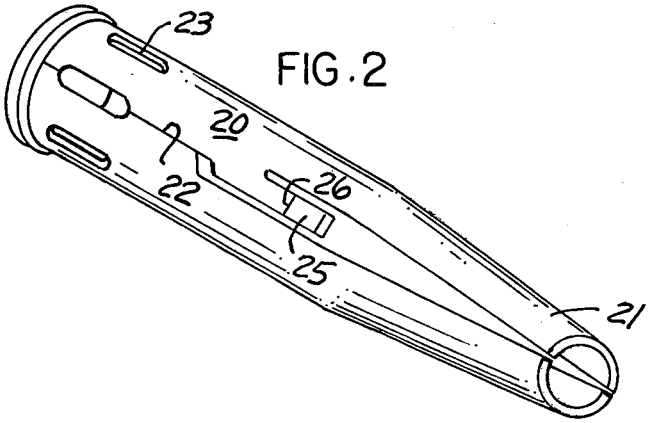

FIG. 2 illustrates an inner sleeve 20 adapted to be inserted into the outer sleeve 10 shown in FIG. 1. The inner sleeve 20 includes a forward mating portion such as deflectible fingers 21, an axial seam 22, a plurality of slots 23 in the rear portion of the sleeve, and a radial projection or finger 25 that includes a rearwardly facing shoulder 26.

Figure 3:
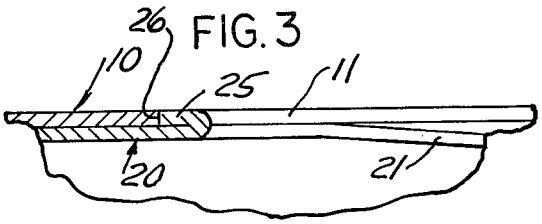

FIG. 3 illustrates a partial cut away view of inner sleeve 20 and outer sleeve 10 assembled together. This figure illustrates how the rearwardly facing shoulder 26 of the radial projection 25 of the inner sleeve 20 engages the forwardly facing shoulder 13 of the slot 11 in the outer sleeve 10.

FIG. 4, 5 and 6 illustrate an inner sleeve 20, a first outer sleeve 40, a second outer sleeve 50 and a fourth sleeve 30 that comprise the contact assembly.

FIG. 4 illustrates the fourth sleeve 30 that includes an enlarged rear portion 32 and an inwardly chamfered forward portion 31 that is for guiding a pin type contact (not shown) into the sleeve 30.

FIG. 5 illustrates the first outer sleeve 40 and the second outer sleeve 50. The first outer sleeve 40 includes an inwardly extending rear portion 43 terminating into a forwardly facing shouler 44, an annular shoulder 42 around the outside of the sleeve 40, a forward end 45 and a cut away portion having a forward end surface 41. The second outer sleeve 50 includes an axial seam 51 and a rearwardly facing end surface 55.

FIG. 6 illustrates the inner sleeve of 20 of the contact assembly which includes an axially extending seam 22, a forward mating portion 21, a rear portion that includes a plurality of slots 23, and in the intermediate portion of the sleeve 20 a radially extending projection 25 that includes a rearwardly facing shoulder 26.

FIG. 7 illustrates a partial cut away view of a contact assembly including the sleeves shown in FIGS. 4–6. This figure illustrates how the radial projection 25 of the inner sleeve 20 is an axially extending finger that is bent back upon itself by bending it outwardly and rearwardly to provide a rearwardly facing shoulder 26 that engages the cutaway end surface 41 of the first outer sleeve 40. When the sleeves are assembled together the forward portion 31 of the fourth sleeve 30 captivates the second outer sleeve 50 between the forward end 31 of the fourth sleeve and the forward end 45 of the second sleeve. The enlarged portion 32 of the fourth sleeve 30 is then formed around the annular projection 42 on the second outer sleeve to mechanically link together all of the sleeves.

Having described the invention, what is claimed is:

1. An electrical contact assembly for receiving an electrical wire, said electrical contact assembly comprising:

an inner sleeve stamped and formed from a sheet of metal, said sleeve having a rear wire receiving portion, a front mating portion and an intermediate portion between said rear portion and said front portion, said intermediate portion including a radial projection that includes a rearwardly facing shoulder; and an outer sleeve telescopically mounted to the inner sleeve, said outer sleeve having a slot therein extending rearwardly from the forward end of the outer sleeve and terminating in a forwardly facing shoulder, said forwardly facing shoulder at the end of said slot in said outer sleeve engaging the rearwardly facing shoulder of the radial projection of the inner sleeve.

2. The combination recited in claim 1 wherein the radial projection is an axially extending finger having its forward end portion bent back over itself to provide the rearwardly facing shoulder on the outside of said inner sleeve.

3. An electrical contact assembly for receiving an electrical wire, said electrical contact assembly comprisir 3:

an inner sleeve stamped and formed from a sheet of metal, said inner sleeve having a rear wire receiving portion, a forward mating portion, and an intermediate portion having a radial projection that includes a rearwardly facing shoulder;

a first outer sleeve telescopically mounted over the rear portion of said inner sleeve, said first outer sleeve having a cut away portion at the forward end of the inner sleeve, said cut away portion having a forward facing end surface engaging the rearwardly facing shoulder of the radial projection on the inner sleeve; and a second outer sleeve telescopically mounted over the forward mating portion of said inner sleeve, said second outer sleeve having its rear end abutting the forward end of the first outer sleeve so that said cut away portion of said first outer sleeve provides an aperture between the first outer sleeve and the second outer sleeve through which the radial projection on the inner sleeve projects with said rearwardly facing shoulder of said radial projection engaging a portion of the forward end surface of the cut away portion in said first outer sleeve.

4. The combination as recited in claim 3 including a fourth sleeve telescopically mounted over the second outer sleeve, said fourth outer sleeve including at the forward end thereof means for guiding a member into the second outer sleeve so that said member may mate with the mating portion of said inner sleeve.

5. The combination recited in claim 3 wherein the radial projection is an axially extending finger having its forward end portion bent back over itself to provide the rearwardly facing shoulder on the outside of said inner sleeve.

6. The combination recited in claim 4 wherein the radial projection is an axially extending finger having its forward end portion bent back over itself to provide the rearwardly facing shoulder on the outside of said inner sleeve.

* * * * *